US005682823A

United States Patent [19]

Tihansky et al.

[11] Patent Number: 5,682,823

[45] Date of Patent: Nov. 4, 1997

[54] REMOVABLE INSULATED COVER AND METHOD FOR TRANSPORTING HOT OVERSIZED STEEL INGOTS

[75] Inventors: Eugene L. Tihansky; James J. Romeo; Gregory F. Paolini, all of Bethlehem, Pa.

[73] Assignee: Bethlehem Steel Corporation

[21] Appl. No.: 697,382

[22] Filed: Aug. 23, 1996

[51] Int. Cl.[6] ..... B61D 39/00

[52] U.S. Cl. ..... 105/377.08; 105/378; 105/377.1; 296/36; 296/100

[58] Field of Search ..... 105/377.04, 377.05, 105/377.06, 377.08, 377.1, 377.09, 378; 296/36, 100

[56] References Cited

U.S. PATENT DOCUMENTS

| | | |
|---|---|---|
| 2,977,900 | 4/1961 | Farrar . |
| 3,408,958 | 11/1968 | Van De Plasch . |
| 3,498,237 | 3/1970 | Loveland et al. . |
| 3,994,240 | 11/1976 | Berg et al. . |
| 5,036,775 | 8/1991 | Snead . |
| 5,054,402 | 10/1991 | Brassell . |

FOREIGN PATENT DOCUMENTS

| | | | |
|---|---|---|---|
| 168697 | 1/1986 | European Pat. Off. | 105/377.1 |
| 438701 | 7/1991 | European Pat. Off. | 105/377.1 |
| 650863 | 3/1979 | U.S.S.R. | 105/377.1 |
| 1474005 | 4/1989 | U.S.S.R. | 105/378 |
| 2101548 | 1/1983 | United Kingdom | 105/377.1 |

*Primary Examiner*—S. Joseph Morano
*Attorney, Agent, or Firm*—Harold I. Masteller, Jr.

[57] ABSTRACT

A removable cover for encasing freight having an oversized portion of freight positioned on a bed of a freight car is shown including an interior insulated space for encasing the freight, openings through which the oversized portion of freight extends, and sidewalls having pockets of insulation shaped to receive the oversized portion of the freight. The sidewalls are movably attached to the removable cover and positioned to be moved to a closed position that covers the openings and encases the oversized portion of freight extending through said openings within the pockets of insulation. The removable cover further includes a seal that extends between the bed of the freight car and the removable cover, and the seal includes a granular insulation material in which the removable cover is imbedded.

36 Claims, 6 Drawing Sheets

1
33
21
26
15
28a
28
22
39
39
51a
51a
51z
15a
51z
17a
53
50
49a
3
53
17
50
49a
46
49b
41
41
49b
46
38
38a
43
43
58
42
42
58
47
44
44
47
D
4
5b
5a
6c
6
6a
6c
6b
6b
6a
6
18a
18
2
5
W

REMOVABLE INSULATED COVER AND METHOD FOR TRANSPORTING HOT OVERSIZED STEEL INGOTS

BACKGROUND OF THE INVENTION

This invention is directed to an insulated railroad car cover for shipping ingots from a steel mill operation to a finishing facility, and in particular, it is directed to an insulated railroad car cover suited for maintaining the temperature of "hot" oversized ingots shipped by rail to a distant finishing operation. In certain instances, steel making facilities that cast raw ingots and the like can be located at great distances from the finial finishing operation that shapes the cast ingots into various finished products. In such cases, and where the steel manufacturer is shipping large ingots that can range up to 130 inches in diameter and up to 290 tons in weight, rail is the best means of transportation. However, railroad standards dictate that the extreme overall width of a railroad car and its freight must not exceed eleven feet. To avoid violating this maximum width standard, typical freight cars are built not to exceed ten foot eight inches in width. Therefore, it is quite obvious that large oversized ingots that measure up to 130 inches in diameter will extend beyond the side sills of a ten foot eight inch wide freight car.

This ten foot eight inch industry standard presents various problems for the steelmaker. For example, it is desirable to ship ingots to arrive "hot" at the finishing location to avoid reheating the ingots in soaking pits prior to the finishing operation. However, oversized ingots can't be shipped in insulated box cars because their large diameters exceed the width of such cars. Consequently, present shipping practice dictates loading oversized ingots onto open bed flat cars to permit their large diameters to overhang the side sill width of the open cars. Open flat cars expose the hot ingots to air during loading and shipping, and the hot ingots are cooled to below finishing temperatures before they arrive at the finishing operation. One way to overcome the heat loss problem is to provide a removable insulated cover that is be placed over the ingot during shipping. The removable insulated cover would enclose the hot ingot and maintain the temperature of the steel. However, the small working space, the difference between a 130 inch diameter ingot and the eleven foot maximum width standard, doesn't provide sufficient space to use any of the insulated covers that are presently known in the art. For example, a 130 inch diameter ingot leaves only a one inch clearance space along both sides of the ingot. State-of-the-art freight car covers, both insulated and un-insulated for example, as shown in U.S. Pat. No. 2,977,900 granted to Farrar and U.S. Pat. No. 3,994,240 granted to Berg et al., are not suited for use in such narrow spaces. These prior covers would not fit within the one inch working space between the oversized ingot and the maximum eleven foot width standard. If these prior covers were enlarged to enclose a 130 inch diameter ingot, or other oversized freight, their sidewalls would exceed the eleven foot maximum width standard. Both patents teach using freight car covers that have substantially vertical side walls. The vertical sidewalls are shown supported on structural members located inboard of the side sills of the freight cars. The patents fail to show any teaching or suggestion that would enable a user to enclose freight that extends outboard of the freight car side sills. Based upon the teaching of these patents, if the cover dimensions were enlarged to accommodate oversized freight, the cover sidewalls would hang unsupported outboard of the side sills, and an air gap would extend along the length of the freight car between the overhanging cover sidewall and side sill of the freight car.

SUMMARY OF THE INVENTION

It is therefore the object of this invention to provide a removable insulated railroad car cover that will accommodate oversized freight without exceeding freight car width standards.

It is a further object of this invention to provide a removable insulated railroad car cover having a moveable sidewall piece capable of being moved to a wider outboard position to accommodate oversized freight during loading operations.

It is still a further object of this invention to provide a removable insulated railroad car cover having a moveable sidewall piece capable of being moved to a closed position to encase the loaded oversized freight within the removable cover.

And finally it is still a further object of this invention to provide a granular seal in which the removable insulated cover it imbedded to reduce heat loss.

I have discovered that the foregoing objects can be attained by providing a removable cover for encasing freight, including an oversized portion of freight positioned on a bed of a freight car. The removable cover includes an interior insulated space for encasing the freight, openings through which the oversized portion of freight extends, and moveable sidewall pieces that include pockets of insulation that receive the oversized portion of the freight that extends through the openings. The sidewalls are movably attached to the removable insulated cover they can be moved to either a closed position or open position to cover or uncover the openings through which the oversized portion of freight extends. The removable cover further includes a seal that extends between the bed of the freight car and the removable cover, and the seal includes a granular insulation material in which the removable cover is imbedded.

DETAILED DESCRIPTION OF THE PREFERRED EMBODIMENT

Figure 1:
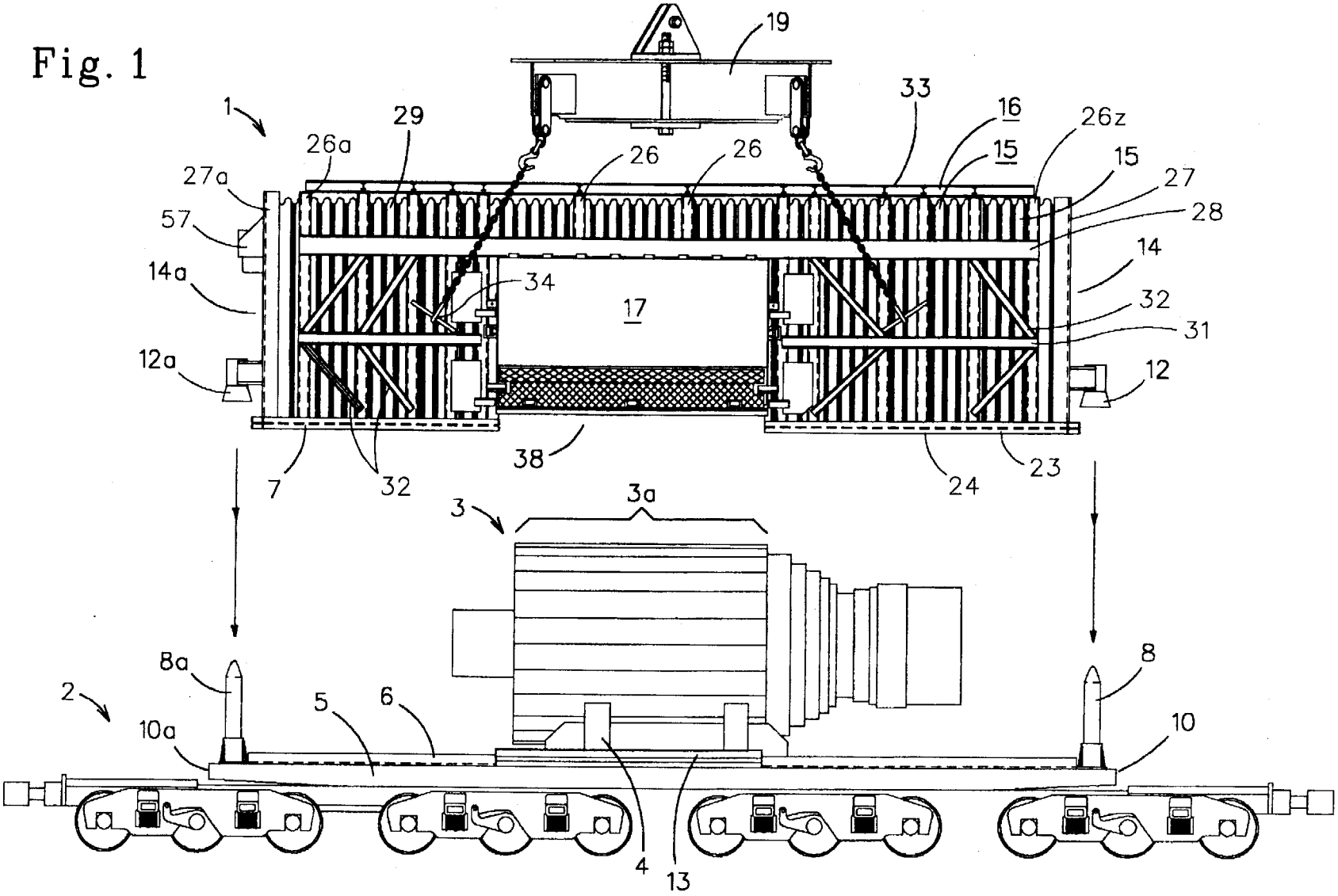
FIG. 1 is an elevation view showing the preferred removable insulated cover being lowered onto the bed of a flat car.
Figure 2:
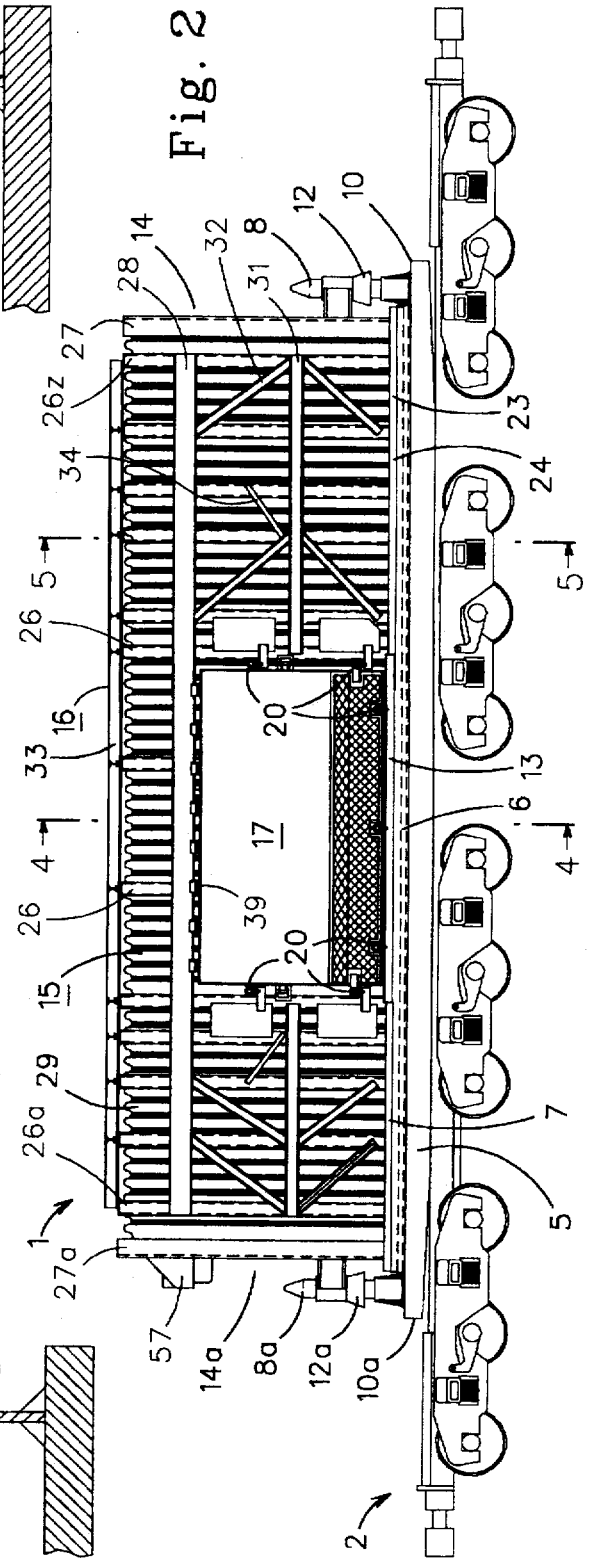
FIG. 2 is an elevation view showing the removable insulated cover of FIG. 1 positioned on the bed of a flat car.
Figure 3:
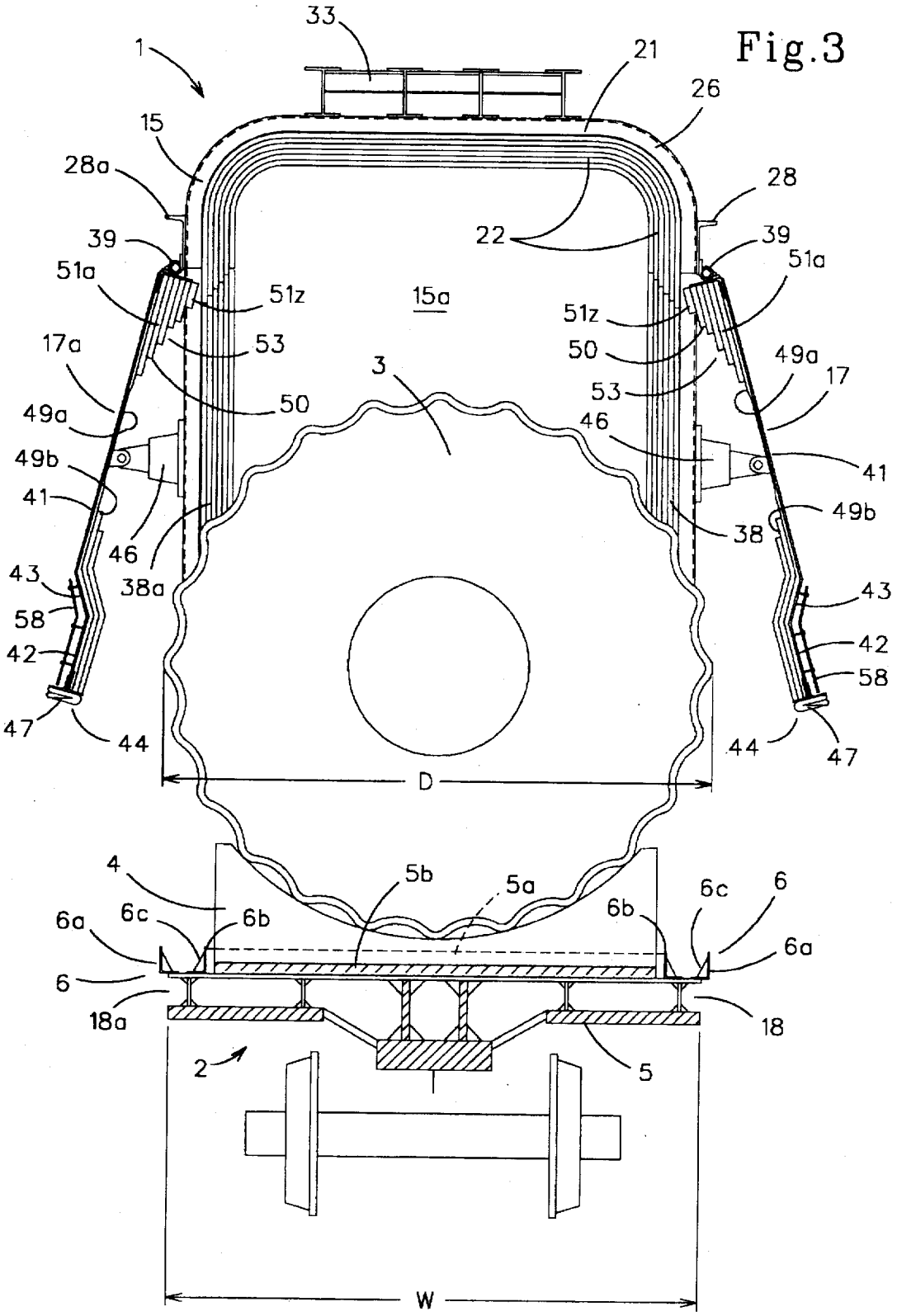
FIG. 3 is a cross-section taken through the preferred embodiment showing moveable sidewall pieces of the removable cover in an open position.

Referring to FIGS. 1–3 of the drawings, the preferred insulated railroad car cover 1 is shown positioned above the bed of a freight car 2 on which an oversized wide diameter ingot 3 is loaded for shipping to a location for finishing. The ingot is support upon standard type blocking 4 used in the freight industry. The freight car includes an open bed 5 and a seal 6 that receives a cooperating seal 7 fastened to the removable insulated cover. Guide posts 8 and 8*a* are positioned at opposite ends 10 and 10*a* of the freight car to receive guide cones 12 and 12*a* fastened to the opposite ends 14 and 14*a* of the insulated railroad car cover. The "post and cone" arrangement properly positions the removable cover 1 with respect to the freight car 2 as it is lowered onto the open bed 5 of the freight car, and the post and cone arrangement functions as a guide to insure that seals 6 and 7 are in proper alignment for mating.

FIG. 3 shows an oversized ingot 3 that has a wide diameter portion "D". Such oversized ingots have diameters that range up to 130 inches, and they can weigh up to 290 tons. These large oversized ingots overhang the side sill width "W" of conventional open bed flat cars. As heretofore mentioned, because the industry standard requires that a freight car and its freight cannot exceed eleven feet in width, a 130 inch diameter ingot leaves only one inch of working space along both sides of a freight car. This dimensional limitation presents problems for both the car builder as well as for the steelmaker who ships large oversized ingots by rail. The railroad car builder is forced to construct a removable insulated cover that will fit into the one inch clearance space. Conventional construction methods require covers to have sidewalls sections that are greater than a one inch cross-section in order to provide adequate insulation to both protect the cover structure and maintain an ingot at hot finishing temperatures. In order not to exceed the maximum width standard, the car builder is forced to build a car cover having such a one inch sidewall cross-section. Such thin sidewalls are structurally unsound, and such sidewall sections will extend outboard of the side sills. This presents a fastening problem for the car builder.

In addition to the above structural problems, the intense heat that radiates from the surface of a "hot" oversized ingot can cause damage to the structural members in the cover sidewalls. The one inch working space gives insufficient space to provide proper insulation in these sidewall sections positioned adjacent the large diameter portion "D" of the ingot. There is simply not enough space to provide the usual amount of insulation material to protect the sidewall structure. Nevertheless, a car builder could choose to use newer state-of-the-art insulation materials in the cover sidewalls. Newer insulations could provide improved insulation values to protect the structural members, and maintain the ingot temperature. Such state-of-the-art insulation materials include BTU-BLOCK® microporous insulation panels available in ½" to 1½" thick sheets designed for temperature ranges up to 1832° F. However, these modern insulations are very expensive to use, and their use would fail to overcome the heretofore mentioned structural problems that are created by the one inch working space. Structural instability and overhanging sidewalls would continue to be a problem even if modern insulation material were used in the construction of the railroad car cover.

Therefore, under current shipping practice, the steelmaker is required to ship large diameter ingots cold. Such practice is expensive for the steelmaker because the cold ingots must be reheated to finishing temperatures prior to the start of finishing operations.

The preferred embodiment overcomes the aforementioned problems by providing a removable insulated cover 1 that includes an inverted "U" shaped casing 15 supported by an exterior structural framework or skeleton 16. The inverted "U" shaped casing 15 includes opposed moveable sidewall pieces 17 and 17*a* that are located along the length of casing 15 and positioned on opposite sides adjacent the overhanging large diameter portion "D" of the ingot. The moveable sidewall pieces 17 and 17*a* are capable of being moved both in an outboard direction or an inboard direction to uncover or cover the openings 38 and 38*a*. During loading operations, as shown in FIGS. 1 and 3, the moveable sidewall pieces 17 and 17*a* are moved in an outward direction to their most outboard position. This uncovers openings 38 and 38*a* to provide clearance to lower the removable insulated cover 1 over the large diameter "D" that extends beyond the side sills 18 and 18*a* of the railroad car. The large diameter portion "D" extends along only a portion of the ingot length identified as 3*a* in FIG. 1. Therefore, it is only necessary to provide moveable sidewall pieces 17 and 17*a* adjacent the enlarged length 3*a*, however, longer moveable sidewall pieces and openings could be used without departing from the scope of this invention.

Figure 4:
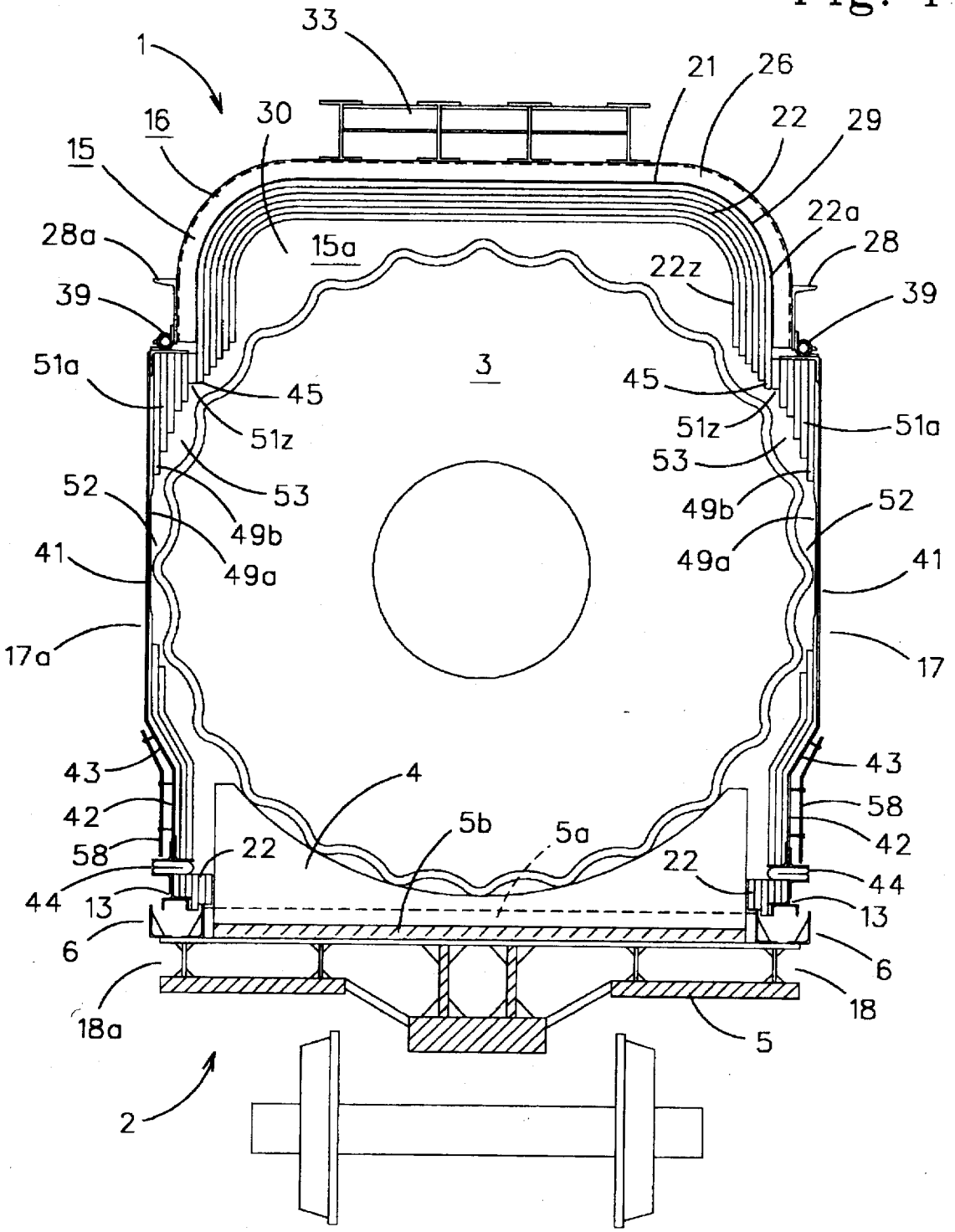
FIG. 4 is a cross-section taken along the lines 4—4 of FIG. 2 showing moveable sidewall pieces of the removable cover in a closed position.

Referring again to FIGS. 1–3, a lifting device 19, shown only in FIG. 1, lowers the removable cover 1 onto the open bed 5 of the flat car 2 to encase ingot 3 within the insulated interior space 15*a*. As shown in FIG. 2, during the lowering operation cones 12 and 12*a* engage posts 8 and 8*a* to properly position the removable insulated cover and align cover seal 7 with the cooperating freight car seal 6 located along the bed of the freight car. After the removable insulated cover is properly positioned on the freight car bed, the moveable sidewall pieces 17 and 17*a* are moved to their inboard closed position to cover openings 38 and 38*a* to completely encase the large diameter portion 3*a* of the ingot within space 15*a* as shown in FIG. 4. The moveable sidewall pieces 17 and 17*a* are then secured by fasteners 20 that lock the moveable sidewalls in their closed position as shown in FIG. 2.

Referring now to FIGS. 1–7, the preferred removable cover embodiment comprises four primary assemblies, an inverted "U" shaped casing 15 that includes opposed openings 38 and 38*a* through which the oversized portion of the loaded freight extends, moveable sidewall pieces 17 and 17*a* to cover or uncover openings 38 and 38*a*, an exterior structural framework attached to and supporting casing 15 and including a seal 7, and a seal 6 attached to and extending along the bed 5 of the freight car, seal 6 containing a granular insulation material in which seal 7 is imbedded.

As shown in FIGS. 3–8 a layer of cast insulation 5*a* extends along the length of the freight car bed 5 between the bounds of seal 6, and a strip of compressive insulation 5*b* is placed under the blocking 4 that supports the hot ingot. These insulation materials protect the bed and structural members of the railroad car from the intense heat generated by the hot ingot.

The exterior or external structural framework 16 comprises a rectangular frame section 23, a plurality of spaced apart inverted "U" shaped channel members 26, and a pair of end frames 27 and 27*a* located at the cover ends 14 and 14*a*. One leg of each spaced apart inverted "U" shaped member 26 is attached to the side member 24 of frame 23 and the opposite leg of each "U" shaped member 26 is attached to the opposite side member 24*a*, see FIG. 5. A first longitudinal channel 28, that extends from the first inverted "U" shaped member 26*a* to the last member 26*z*, is positioned above the first movable sidewall piece 17, and second longitudinal channel 28*a*, located on the opposite side of casing 15, is positioned above the second moveable sidewall piece 17*a*. Channels 28 and 28*a* are attached to the vertical legs of the inverted "U" shaped channel members 26 to provide a ridged support for attaching the moveable sidewall pieces 17 and 17*a* to the structural framework 16. Additional channel sections 31 and diagonal bracing 32 are attached to and positioned between frame 23 and the channel sections 28 and 28a to stiffen the framework 16 and provide additional fastening surfaces to attach casing 15. A top frame 33 comprising an assembly of longitudinal and transverse beams is attached to members 26 adjacent the top section 21 of the casing to further stiffen the external framework 16 and provide additional support for the casing 15. In addition, framework 16 also includes a number of "picks" 34 that are positioned above the center of gravity to provide means for attaching the lifting device 19 during loading and unloading operations.

The rectangular frame section 23 forms seal 7. Seal 6, attached to and extending along the bed 5 of the freight car, is shaped to cooperate with corresponding seal 7. However, it should be understood that rectangular shaped seal 7 and its corresponding seal member 6 on the freight car can comprise any reasonable shape suitable to a car builder without departing from the scope of this invention, and therefore, seals 6 and 7 positioned between the removable insulated cover and freight car bed are not restricted to a rectangular shape.

Figure 7:
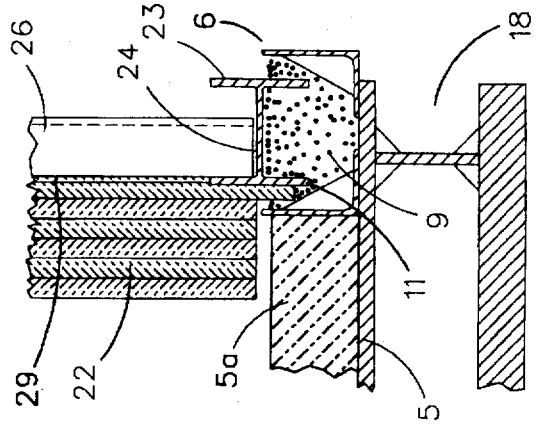
FIG. 7 is an enlarged cross-section showing a seal means along a portion of the casing of the preferred embodiment.
Figure 6:
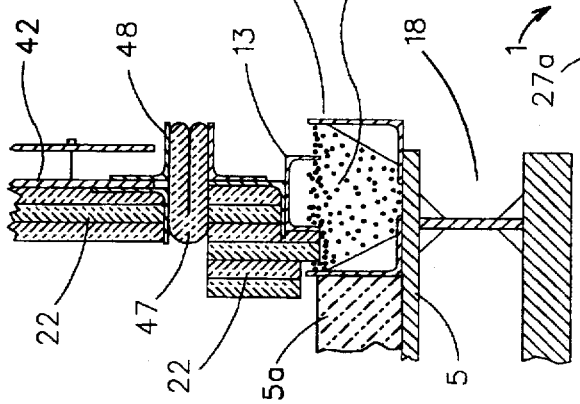
FIG. 6 is an enlarged cross-section showing a seal means attached to a moveable sidewall piece of the preferred embodiment.

As shown more clearly in FIGS. 6 and 7, seal 6 extends along the periphery of the freight car bed 5. The seal is shaped to provide a receptacle that contains a granular insulating material 9. For example, a material such as sand or gravel or the like. Seal 6 also includes threshold sections 13, attached to the bed 5 at locations that correspond with the openings 38 and 38a when the removable insulated cover is positioned on the freight car bed.

The cover seal 7 formed by frame 23 includes downward extending legs 11 that are imbedded within the granular insulation material 9 when the seals 6 and 7 are engaged. In the preferred embodiment seal 6 is shown comprising a pair of angles 6a and 6b and spaced apart stiffeners 6c. Seal 7 is shown comprising an I-beam section that is orientated to extend its flanges in a downward direction to imbed the downward pointing flanges into the granular insulation material contained within seal 6. As discussed in greater detail below, the moveable sidewall pieces 17 and 17a also include a seal means 44 that engages the threshold section 13 when the sidewall pieces are moved to their closed position to cover openings 38 and 38a. It should be understood that seals 6 and 7 can comprise any suitable cross-sectional shape capable of imbedding seal 7 within the granular insulation 9 contained in seal 6 as described above.

Casing 15 comprises corrugated sheeting 29 attached to and supported by the various structural members of the external framework 16. The opposite ends of casing 15, located adjacent cover ends 14 and 14a, are closed off with end wall plates that are fastened to end wall frames 27 and 27a of framework 16. Insulation 22, such as "KAOWOOL" insulation, are attached to the inside surface of the inverted "U" shaped corrugated sheeting 29 and the inside surfaces of the end wall plates fastened to frames 27 and 27a. The insulated surfaces define an interior space 15a that covers the oversized ingot when the removable cover 1 is placed on the bed of the freight car. As more clearly shown in the cross-section view of FIG. 14, the insulated walls of the interior space 15a are built up with various blanket layers of insulation 22a–22z to provide an insulated wall thickness that will produce a desired "R" value. The blankets of insulation are fastened to the inside surfaces of the corrugated sheeting and end wall plates by any suitable fastening means well known in the art.

Casing 15 also includes openings 38 and 38a located along opposite legs or sides of the inverted "U" shaped corrugated sheeting 29. The openings extend through the sheeting and the blankets of insulation 22a–22z attached to the inside surface of the sheeting 29 as shown in FIGS. 4 and 6. The moveable sidewall pieces 17 and 17a are attached to the longitudinal channels 28 and 28a at a location adjacent openings 38 and 38a to enable an operator to cover and uncover the openings.

Each moveable sidewall piece 17 and 17a includes a top panel section 41, a bottom panel 42, and at least one transition panel 43 that extends between the top panel 41 and the bottom panel 42. An expanded metal sheet 58 is attached to lower portion of each moveable sidewall piece with elongated fasteners that space the sheet outward from the sidewall pieces 17 and 17a. Sheets 58 provide a heat shield or guard beam that prevents workers from accidently contacting the sidewall pieces that may be overheated by the encased hot oversized ingot.

In the preferred embodiment, the top panel 41 is pivotally attached to the longitudinal channels 28 and 28a by hinges 39. This arrangement places the top panel 41 outboard of the external framework 16 when the moveable sidewall pieces are in their closed position covering openings 38 and 38a. A power source such as a hydraulic jack 46, screw jack, or other means extends between the external framework and the top panel to provide means for moving or rotating the moveable sidewall pieces 17 and 17a in an outboard direction or an inboard direction. The bottom panel 42 includes a seal means 44 that is shaped to cooperate with the seal formed by thresholds 13 that are attached to the freight car bed 5 adjacent openings 38 and 38a.

When jack 46 is activated to rotate the moveable sidewalls 17 and 17a to their open position, outboard of the side sills 18 and 18a as shown in FIG. 3, openings 38 and 38a are uncovered. The uncovered openings provide a clearance space around the oversized portion of the freight that extends outboard of the side sills 18 and 18a. The clearance space permits the removable cover to be lowered onto the bed of the freight car without encountering interference at the large diameter portion "D". After the removable insulated cover 1 is positioned to engage seals 6 and 7 and lowered onto the bed of the freight car, jack 46 is operated to move the sidewall pieces 17 and 17a to their closed position over openings 38 and 38a and completely encase the oversized portion of the ingot that extends outboard, within the now closed interior space 15a of the cover.

As shown in more detail in FIG. 6, seal means 44 is attached to the bottom panel section 42 by angles 48, and the seal comprises flexible insulation material 47 attached along the lower edge of the bottom panel 42. When the sidewalls 17 and 17a are moved to their closed position the flexible insulation 48 compress against threshold 13 to facilitate engagement with the threshold 13 and the blankets of insulation 22 attached to the threshold section. The compressed insulation 47 forms a tight seal along the length of threshold 13 and reduces heat loss along the bottom edge of the sidewall pieces 17 and 17a.

In addition to the bottom seal 44, FIG. 4 shows that the remaining three sides of the moveable sidewalls 17 and 17a include an insulation overlap 45 adjacent the openings 38 and 38a to prevent heat loss along the periphery thereof. The seal means 44, that extends along the bottom panel 42, and the insulation overlap 45 that extends along the other three sides of the moveable sidewall pieces, cooperate to provide a continuous thermal seal along periphery of the movable sidewall pieces 17 and 17a and adjacent openings 38 and 38a.

Figure 5:
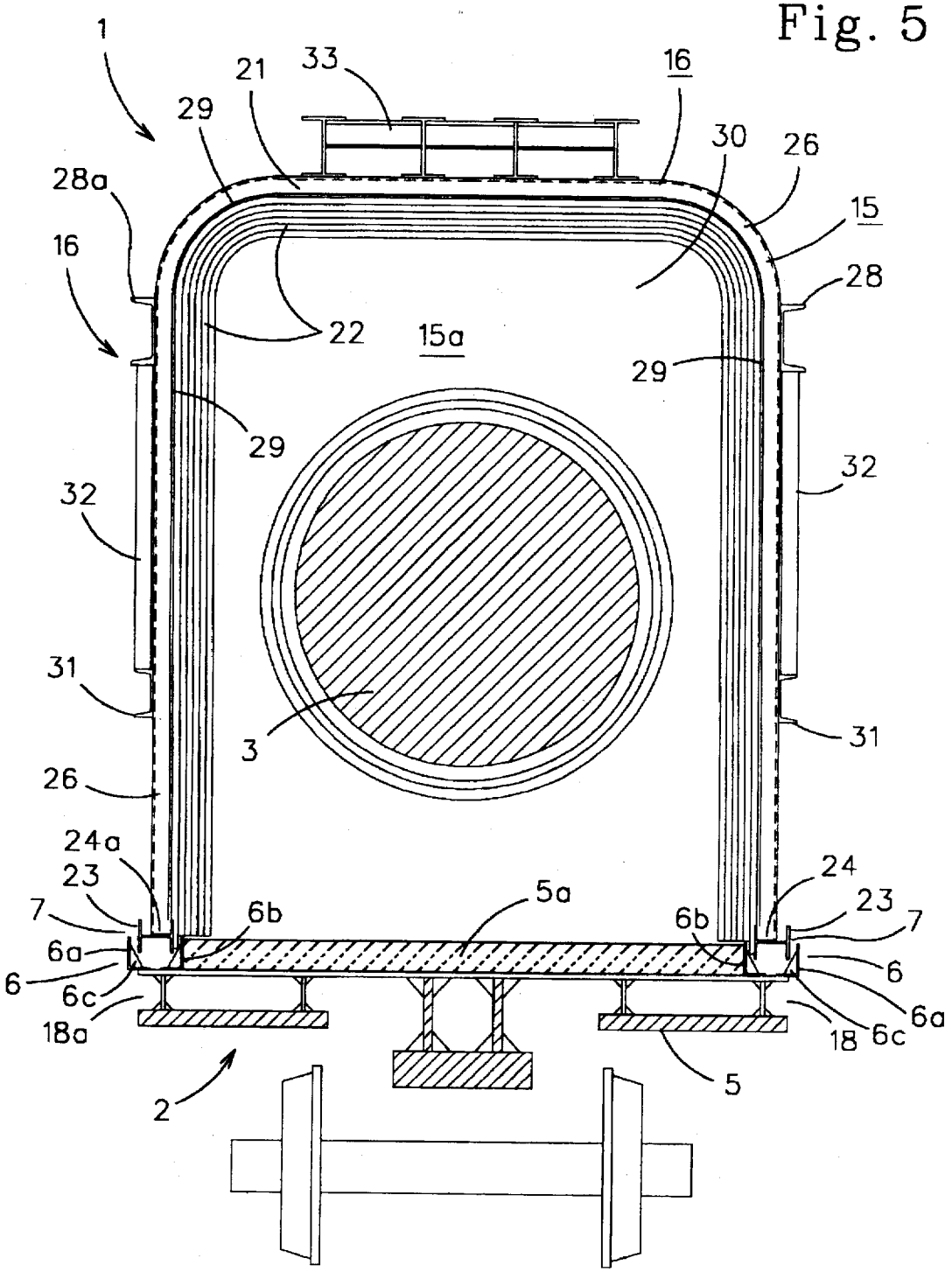
FIG. 5 is a cross-section taken along the lines 5—5 of FIG. 2 showing the casing of the removable cover.

When the moveable sidewalls 17 and 17*a* are retracted to their closed position, as shown in FIGS. 4 and 5, the top panel 41 is positioned outboard of the freight car side sills 18 and 18*a* at a distance that accommodates the large diameter "D", and also at a distance that does not exceed the eleven foot maximum width standard set by the railroad industry. At the same time, the bottom panel 42 is positioned inboard of the side sills 18 and 18*a* to engage seal 44 with the threshold 13 adjacent openings 38 and 38*a*. And the transition panel 43 extends between 20 the top and bottom panels to form a continuous sidewall piece that is supported on the bed of the freight car while it encases the oversized portion of the ingot that extends outboard of the freight car bed.

Insulation shaped to simulate the contour of the large diameter portion "D" of the ingot is attached to the inside surface of the moveable sidewall pieces 17 and 17*a*. The shaped insulation 49 includes a buildup of various layers of insulation comprising a first and a second high temperature sheet of insulation positioned between panels 41, 42, and 43 and a buildup of several blankets or layers of wool insulation 51*a*–51*z*. The high temperature insulation sheets 49*a* and 49*b* comprise thin sections or layers of insulation such as "BTU- BLOCK". The first sheet 49*a* is attached to the entire inside surface of its respective moveable sidewall piece, either 17 or 17*a*, to provide insulation directly adjacent the smallest working space 52 where the ingot overhangs the freight car side sills 18 and 18*a*. The second sheet of high temperature insulation 49*b* is positioned inboard of sheet 49*a* and includes a cutout portion 50 that provides clearance for the wide diameter "D". The wool blankets 51*a*–51*z* that are superimposed on sheet 49*b* also include cutout portions 50 to provide further clearance for the wide diameter "D". The combined cutout portions 50 of sheet 49*b* and cutout portions 50 of blankets 51*a*–51*z* provide an insulated pocket 53 shaped to receive the portion of the ingot that extends through openings 38 and 38*a*.

Figure 8:
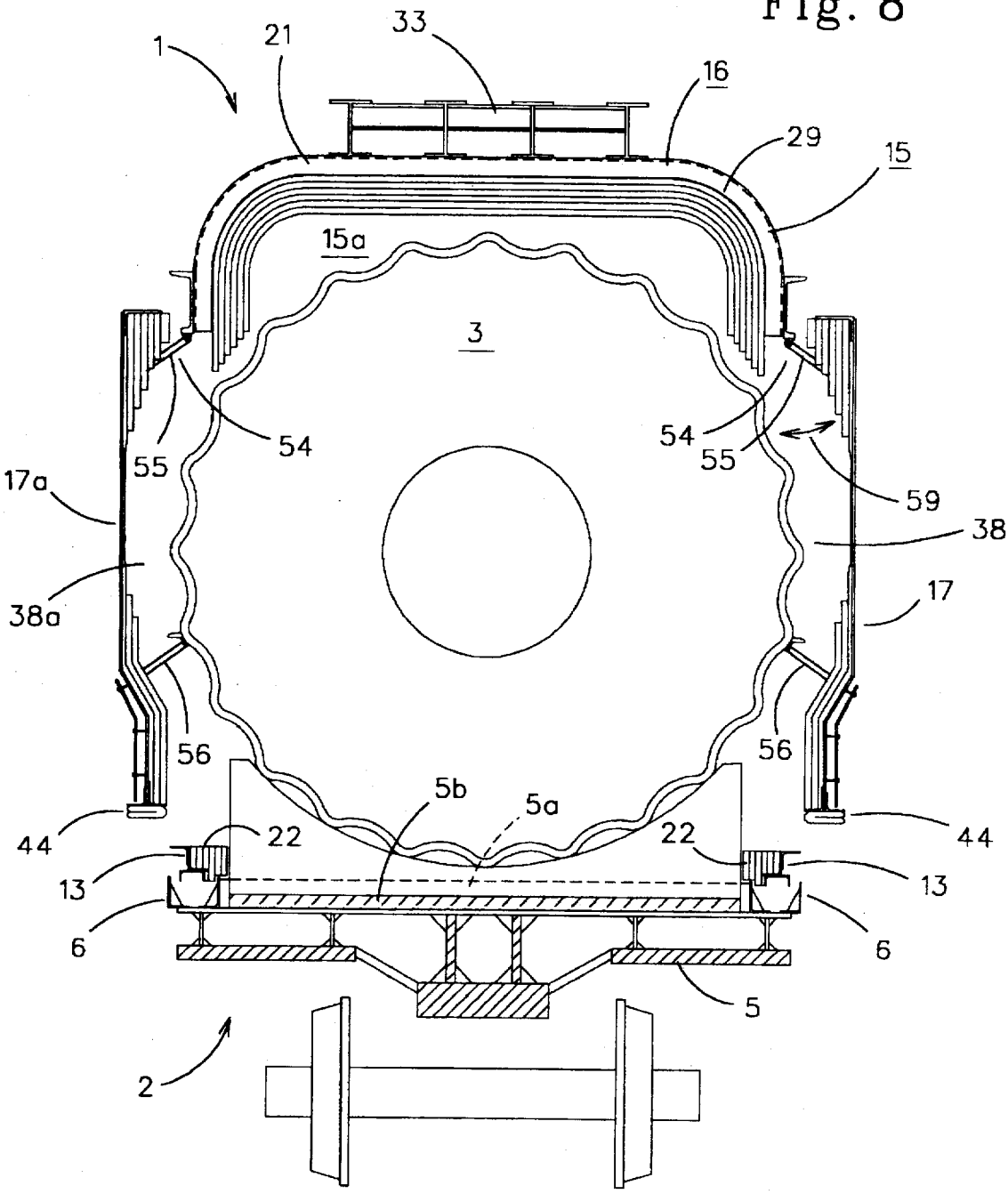
FIG. 8 is a cross, section showing an alternate embodiment for movably attaching the sidewall pieces to the removable cover.

Although the preferred embodiment shows a hinge means 39 to move the sidewall pieces 17 and 17*a* to their open and closed positions to uncover and cover the openings, any suitable means may be used to provide such movement. For example, FIG. 8 shows the a parallelogram 54 providing means to move the sidewalls to either their open position or their closed position. The parallelogram comprises pivot arms 55 and pivot arms 56 that are rotatably attached to the external structural frame 16 and the moveable sidewall pieces 17 and 17*a*. Jacks 46 (not shown) are attached to frame 16 to provide power to operate the parallelogram 54 and move the sidewalls pieces in either an outboard or inboard direction as shown by arrow 59.

Referring to FIG. 2, the removable cover 1 may also include a heat source 57 attached to the casing 15. The heat source communicates with the interior insulated space 15*a* that encases the oversized freight and it is capable of supplying heat to the interior space during loading or unloading operations to maintain the ingot temperature.

While this invention has been described as having a preferred design, it is understood that it is capable of further modifications, uses, and/or adaptations following in general the principle of the invention and including such departures from the present disclosure as come within known or customary practice in the art to which the invention pertains, and as may be applied to the essential features set forth herein, and fall within the scope of the invention limited by the appended claims.

We claim:

1. A removable insulated cover for encasing oversized freight positioned on a bed of a freight car comprising:

a) a casing having an interior insulated space defined by sidewalls, end walls, and a top, said casing having at least one opening extending through at least one of said sidewalls of said casing;

b) at least one moveable sidewall piece attached to said removable insulated cover adjacent said at least one opening;

c) means to move said at least one moveable sidewall piece in an outward direction to uncover said at least one opening and provide a clearance adjacent the oversized freight, said clearance providing room to lower said removable insulated cover onto the freight car in a position to partially encase the oversized freight within said interior insulated space of said casing; and d) means to move said at least one moveable sidewall piece in an inward direction to a closed position that covers said at least one opening, said at least one moveable sidewall piece in said closed position completely encasing the oversized freight within said interior insulated space of said casing when said removable insulated cover is positioned on the bed of the freight car.

2. The removable insulated cover recited in claim 1 including an external framework attached to and supporting said casing, said at least one moveable sidewall piece being attached to said external framework at a location adjacent said at least one opening that extends through at least one of said sidewalls of said casing.

3. The removable insulated cover recited in claim 1 including a seal positioned between said removable insulated cover and the freight car, said seal comprising:

a) a male section attached to said sidewalls and said end walls of said casing, said male section including at least one flange extending in an outward direction; and b) a female section attached to and extending along the bed of the freight car, said female section positioned to correspond with said male section and shaped to provide a receptacle to receive said at least one flange that extends outward from said male section, said receptacle containing an insulation material in which said at least one flange is imbedded when said removable insulated cover is lowered onto the bed of the freight car.

4. The removable insulated cover recited in claim 3 wherein said male section includes an I-beam attached to said sidewalls and said end walls of said casing, said I-beam having flanges extending downward from said casing to engage said receptacle of said female section, said flanges of said I-beam being imbedded within said insulation material contained in said receptacle when said removable insulated cover is lowered onto the bed of the freight car.

5. The removable insulated cover recited in claim 3 wherein said insulation material contained within said receptacle of said female section is a granular material.

6. The removable insulated cover recited in claim 5 wherein said insulation material is sand.

7. The removable insulated cover recited in claim 5 wherein said insulation material is gravel.

8. The removable insulated cover recited in claim 2 wherein said at least one moveable sidewall piece attached to said external framework comprises:

a) a top panel positioned outboard of said external framework and movably attached thereto;

b) a bottom panel having a seal means attached thereto, said seal means shaped to engage a threshold section attached to the bed of the freight car;

c) at least one transition panel extending between said top panel and said bottom panel; and d) a power source attached to said external framework to provide means to move said at least one moveable sidewall piece in an outward direction and an inward direction.

9. The apparatus recited in claim 8 when said removable insulated cover is positioned on the bed of the freight car with said at least one moveable sidewall piece is in said closed position, wherein:

a) said top panel of said at least one moveable sidewall piece is positioned outboard of the bed of the freight car and outboard of the oversized freight;

b) said bottom panel of said at least one moveable sidewall piece is positioned inboard of the bed of the freight car at a location below the oversized freight.

10. The removable insulated cover recited in claim 8 wherein said top panel of said at least one moveable sidewall piece includes:

a) a first layer of insulation attached to said at least one moveable sidewall piece, said first layer of insulation covering the inside surface of said top panel;

b) at least one additional layer of insulation attached to said at least one moveable sidewall piece, said at least one additional layer of insulation having a pocket shaped to receive the oversized freight that extends outboard of the bed of the freight car.

11. The removable insulated cover recited in claim 8 wherein said seal means attached to said bottom panel is a flexible material that will compress when said seal means engages said threshold section.

12. The removable insulated cover recited in claim 1 including a heat source attached to and extending through said casing, said heat source communicating with said interior insulated space.

13. In a freight car having a bed on which freight is loaded for shipping by rail, the freight having an oversized portion that extends outboard of the freight car bed, a removable cover positioned on the bed of the freight car to encase the freight and the oversized portion within said removable cover, the improved removable cover comprising:

a) a casing including;

i) a first sidewall opposite a second sidewall, a first end wall opposite a second end wall, and a top, said sidewalls, end walls and top defining an interior space in which the freight is encased;

ii) at least one layer of insulation attached to and covering said first and second sidewalls, said first and second end walls and said top of said interior space;

iii) a first opening extending through said first sidewall and said at least one layer of insulation, and a second opening extending through said second sidewall and said at least one layer of insulation, said second opening opposite said first opening and, b) a first moveable sidewall piece including;

i) a first top panel movably attached to said removable cover adjacent said first opening, ii) a first bottom panel including a seal to engage a threshold section attached to the bed of the freight car and positioned adjacent said first opening, and iii) at least one transition panel extending from said first top panel to said first bottom panel; and c) a second moveable sidewall piece including;

i) a second top panel movably attached to said removable cover adjacent said second opening, ii) a second bottom panel including a seal to engage a threshold section attached to the bed of the freight car and positioned adjacent said second opening, and iii) at least one transition panel extending from said second top panel to said second bottom panel.

14. The removable cover recited in claim 13 wherein said first top panel is spaced apart from said second top panel a distance "D" greater than a width of the oversized portion that extends outboard of the bed of the freight car.

15. The removable cover recited in claim 13 wherein said first bottom panel is spaced apart from said second bottom panel a distance "W" equal to or less than a side sill width of the bed of the freight car.

16. The removable cover recited in claim 13 wherein said removable cover includes an external framework attached to and supporting said casing, said first moveable sidewall piece being attached to said external framework at a location adjacent said first opening, and said second moveable sidewall piece being attached to said external framework at a location adjacent said second opening.

17. The removable cover recited in claim 16 including a seal positioned between said external framework and the bed of the freight car, said seal comprising:

a) a male section attached to said external framework, said male section including at least one flange extending in an outward direction; and b) a female section attached to and extending along the bed of the freight car, said female section positioned to correspond with said male section and shaped to provide a receptacle to receive said at least one flange that extends outward from said male section, said receptacle containing an insulation material in which said at least one flange is imbedded when said removable cover is lowered onto the bed of the freight car.

18. The removable insulated cover recited in claim 17 wherein said male section includes an I-beam attached to said sidewalls and said end walls of said casing, said I-beam having flanges extending downward from said casing to engage said receptacle of said female section, said flanges of said I-beam being imbedded within said insulation material contained in said receptacle when said removable insulated cover is lowered onto the bed of the freight car.

19. The removable insulated cover recited in claim 17 wherein said insulation material contained within said receptacle of said female section is a granular material.

20. The removable insulated cover recited in claim 19 wherein said insulation material is sand.

21. The removable insulated cover recited in claim 19 wherein said insulation material is gravel.

22. The removable cover recited in claim 13 wherein:

a) said first moveable sidewall piece includes;

i) a first layer of insulation covering said first top panel, and ii) at least one additional layer of insulation adjacent said first layer of insulation covering said first top panel and including a pocket to encase the oversized portion that extends outboard of the freight car bed; and b) said second moveable sidewall piece includes;

i) a first layer of insulation covering said second top panel, and ii) at least one additional layer of insulation adjacent said first layer of insulation covering said second top panel and including a pocket to encase the oversized portion that extends outboard of the freight car bed.

23. The removable cover recited in claim 13 wherein said seal attached to said first bottom panel and said second bottom panel is a flexible material that will compress when said seal means engages said threshold section.

24. The removable cover recited in claim 13 including a heat source attached to and extending through said casing, said heat source communicating with said interior insulated space.

25. A removable cover for encasing freight having an oversized portion of freight positioned on a bed of a freight car comprising:

a) an interior insulated space for encasing the freight;

b) openings through which the oversized portion of freight extends;

c) sidewalls having pockets of insulation shaped to receive the oversized portion of the freight, said sidewalls movably attached to the removable cover and positioned to be moved to a closed position that covers said openings and encases the oversized portion of freight extending through said openings within said pockets of insulation.

26. The removable cover recited in claim 25 further comprising:

a) a seal that extends between the bed of the freight car and said removable cover, said seal including a granular insulation material in which said removable cover is imbedded.

27. A method of finishing an ingot having a large portion "D" greater than a width "W" of a bed of a freight car, said large portion "D" extending outboard of the freight car bed, the steps of the method comprising:

a) loading the ingot onto the bed of the freight car;

b) placing a removable cover on the bed of the freight car to encase the ingot in an interior insulated space within said removable cover, the large portion "D" extending through openings in said removable cover;

c) moving panels to a closed position to cover said openings through which the large portion "D" extends, said panels being movably attached to said removable cover and including a first panel section positioned outboard of the large portion "D" and at least a second panel section spaced inboard of the width "W" of the freight car bed;

d) shipping by rail said ingot incased in said removable cover to a finishing mill;

e) moving said panels to an open position to uncover said openings through which the large portion "D" extends;

f) lifting said removable cover from the bed of the freight car;

g) unloading the ingot from the bed of the freight car;

h) forging or rolling the ingot in the finishing mill to form a product.

28. The method according to claim 27 further comprising:

a) encasing the large portion "D" within a pocket of insulation attached to said panels that are movably attached to said removable cover, the large portion "D" being encased when said panels are moved to said closed position to cover said openings through which the large portion "D" extends.

29. The method according to claim 27 further comprising:

a) imbedding said removable cover within insulation contained within a receptacle attached to and extending along the bed of the freight car when the removable cover is lowered onto the freight car bed.

30. The method according to claim 29 wherein the insulation is granular.

31. The method according to claim 30 wherein the insulation is sand.

32. The method according to claim 30 wherein the insulation is gravel.

33. The method according to claim 27 further comprising:

a) Sealing said moveable panels in said closed position by engaging a seal attached to said panels with a threshold section attached to the bed of the freight car and positioned adjacent said openings through which the large portion "D" extends.

34. The method according to claim 27 further comprising:

a) Introducing a heat source to said interior insulated space before and after the step (d) of shipping by rail said ingot encased in said removable cover to a finishing mill.

35. The method according to claim 27 wherein the ingot is a cylindrical ingot having a large diameter portion "D".

36. The method according to claim 27 where step (h) includes:

a) forging or rolling the ingot into a finished product with no ingot reheating step following the step unloading the ingot from the bed of the freight car.

* * * * *